US006211839B1

(12) United States Patent
Campbell

(10) Patent No.: US 6,211,839 B1
(45) Date of Patent: Apr. 3, 2001

(54) POLARIZED PLANAR LOG PERIODIC ANTENNA

(75) Inventor: Donn van Dyke Campbell, Poway, CA (US)

(73) Assignee: TRW Inc., Redondo Beach, CA (US)

( * ) Notice: Subject to any disclaimer, the term of this patent is extended or adjusted under 35 U.S.C. 154(b) by 0 days.

(21) Appl. No.: 07/234,702

(22) Filed: Aug. 22, 1988

(51) Int. Cl.[7] ..... H01Q 11/10
(52) U.S. Cl. ..... 343/792.5
(58) Field of Search ..... 343/792.5, 789, 343/895

(56) References Cited

U.S. PATENT DOCUMENTS

| | | | | |
|---|---|---|---|---|
| 3,079,602 | * | 2/1963 | DuHamel et al. | 343/792.5 |
| 3,696,438 | * | 10/1972 | Ingerson | 343/792.5 |
| 4,063,249 | * | 12/1977 | Bergander et al. | 343/792.5 |
| 4,652,889 | * | 3/1987 | Bizouard et al. | 343/792.5 |
| 4,658,262 | * | 4/1987 | DuHamel | 343/792.5 |
| 4,772,891 | * | 9/1988 | Svy | 343/792.5 |

OTHER PUBLICATIONS

"Log–Periodic Transmission Line Circuits—Part I:One Port Circuits", Du Hamel et al., IEEE Trans., vol. MTT–14, No. 6 pp. 264–274 (343/792.5).*

* cited by examiner

*Primary Examiner*—Theodore M. Blum
(74) *Attorney, Agent, or Firm*—Michael S. Yatsko; Ronald M. Goldman

(57) ABSTRACT

A polarized planar log periodic antenna is described that is simple in structure and compact in form and which in the dual circularly polarized form may serve as a direct replacement for less capable antennas in RF systems, such as countermeasures systems. An embodiment is characterized by a pair of relatively flat planar linear polarized log periodic antennas of the kind including a plurality of metal radiating elements, each of said radiating elements having the geometry of a circular arc; and the pair of antennas are attached in common to a planar dielectric base; one of said antennas being angularly oriented by ninety degrees relative to the other of said antennas with the radiating elements of one antenna interleaved with the corresponding radiating elements of the other antenna without direct electrical contact between the two antennas. Variations of the structure and novel RF feed line assembly are also described.

21 Claims, 2 Drawing Sheets

POLARIZED PLANAR LOG PERIODIC ANTENNA

FIELD OF THE INVENTION

This invention relates to planar antennas and, more particularly, to planar circularly polarized and linearly polarized log periodic antennas.

BACKGROUND

The antenna is the electrical device which inputs, that is receives, radio frequency (RF) electromagnetic (EM) waves radiated through space to the location of the antenna and couples the RF to an associated RF receiver for processing and/or sends, that is radiates, RF produced by an associated RF transmitter. In the simplest physical form an antenna may be formed of one or more lengths of electrical conductors which serve as "radiating elements" or radiators. To this elemental structure may be added additional metal or dielectric elements to support the radiating element and modify its electrical characteristics. The reader may refer to the technical literature for further details of the design and construction of antennas in general, such as Antenna Theory & Design, Stutzman & Thiele, 1981, published by John Wiley & Sons and Antenna Theory & Design, Constantine A. Balanis, published by Harper & Row 1982, all of which are known to those skilled in the art. One of those antennas is the broadband "spiral" antenna, an antenna characterized by a length of conductor that is of a spiral shape having application in present electronic countermeasures systems.

Target seeking missiles and military aircraft employ search radars that transmit RF energy to search for a target. The RF may be of any frequency within a broad range and may be of a polarized form that makes the RF wave more difficult to detect, either right hand or left hand elliptical or circularly polarized. To thwart this electronic threat the target aircraft must have the means to detect and then confuse or deceive the search radar, which are referred to as electronic countermeasures systems or, more simply, ECM systems. To be effective in the present electronic warfare environment an ECM system for military aircraft should be able to instantaneously sense incident RF energy over a broad frequency range, approaching a decade of frequency, 2 GHz to 18 GHz by way of example, to ensure detection of RF emitted by the search radars of hostile aircraft and missiles.

The EM waves used in this application as is known may be polarized and that polarization can vary from linear to circular. Moreover the circular polarized EM waves may have a right or left elliptical or circular polarization. A right circularly polarized antenna structure will not detect a left circularly polarized wave and vice versa. Thus, an electronic countermeasures system equipped with conventional sensor antennas, such as broadband spiral antennas, would be 'blind' to some threats.

To attain the capability to meet the aforedescribed electronic threats present day countermeasures systems must be modified to double the number of spiral antennas and associated circuitry to detect both right and left elliptically polarized EM waves. Even if the increased cost were to be disregarded as a factor, space on military aircraft is at a premium or is simply unavailable and additional equipments cannot easily be accommodated. A need exists for an antenna of simple structure capable of detecting both kinds of polarized EM waves to replace the less capable antenna in ECM systems without the addition of space and weight.

U.S. Pat. No. 3,681,772 granted Aug. 1, 1972 to P. G. Ingerson for a "Modulated Arm Width Spiral Antenna" shows that it is known to provide an antenna that detects EM waves in both senses of circular polarization. U.S. Pat. No. 4,243,993 granted Jan. 6, 1981 to B. J. Lamberty et al. for a "Broadband Center Fed Spiral Antenna" shows another antenna for that same purpose. These structures take advantage of a "converted mode" to detect EM waves of both kinds of polarization. The converted mode operation is attained by a series of impedance discontinuities or reflection regions along the antenna arms which selectively reflect the antenna currents. This reflection "converts" the sense of polarization from right to left and conversely. The disadvantage of the foregoing antenna lies in its inability to effect total reflection of the excitation currents. Residual currents cause radiation of the opposite sense of polarization, increasing the axial ratio and degrading the radiation pattern and antenna gain.

Others have previously discovered that an antenna structure could be made compact in size and essentially planar in form. This compact planar design permitted efficient use on aircraft and also permitted assembly by "metal on insulator" plating techniques familiar to those skilled in the printed circuit board art. Thus for example the spiral antenna referred to earlier has been duplicated in planar form as is depicted in the publication no. "Antenna 587-1" published by the Military Electronics & Avionics Division of TRW, Inc., the assignee of the present application.

The log periodic antenna, another kind of antenna structure familiar to many in one form as a TV antenna, which is of linear polarization, has also been produced in compact planar form. An example of the structure of such a planar log periodic antenna is presented in the advertisement of AEL appearing in their catalog #6847.5MR illustrating model APO 1466. As the advertisement states: "The log periodic as well as equiangular spiral antennas can be made in planar form. Such an antenna exhibits excellent frequency independent free space radiation patterns. . . . this linearly polarized antenna can be flush mounted for airborne application, used as parabolic reflector feed, and for general purpose low profile installations."

A characteristic feature of the AEL antenna is that it is cavity backed, that is the planar surface, like a pot lid, is supported in a pot shaped metal container, that defines a high frequency tuned cavity. As those familiar with this antenna recognize the cavity backing serves to prevent RF leakage from the antenna's underside into the aircraft carrying the antenna as well as to synergistically enhance the electrical characteristics of the radiating elements forming the antenna.

The aforedescribed AEL antenna as illustrated contains two electrically conductive metal stems arranged on a common axis that extends through the center of a circular shaped base, the latter of which is formed of dielectric material, with the stems being in opposed end to end relationship about said center. Each of the stems contains transversely extending branches; more specifically there are a plurality of conductive metal branches spaced from one another along the length of and extending transversely from each stem. Each of the branches forms a circular arc, extending almost over a quarter of the circle. Odd numbered ones of those branches extend to the right of the stem and even numbered ones extend to the left of the associated stem. Each of the two conductors serves as a radiating or receptor element of the antenna with the overall characteristic of the antenna being principally determined by the effect of the combination of the two radiating elements.

The physical shape of the linearly polarized antenna is simple and beneficial. Linear polarization is useful in some applications where the polarization is known or where it is desirable for the antenna to discriminate against the cross polarized EM field components.

An object of the present invention is to provide an antenna structure that allows detection of both right and left hand circular polarized RF energy, without resorting to the "converted mode." A further object is to provide an antenna structure that allows easy installation of the transmission lines and which eliminates the need for two 180 degree hybrids found in prior designs, resulting in reduced cost and complexity. An additional object of the invention is to provide a dual polarized antenna structure that eliminates the broadband unbalanced to balanced transitions required in prior dual polarized antenna structures. A still further object of the invention is to provide an improved planar antenna and feed structure that enhances linearly polarized and circularly polarized antennas.

SUMMARY OF THE INVENTION

The present invention achieves the aforedescribed objects by a physically compact structure fairly simple in appearance capable of being flush mounted in aircraft siding. The novel antenna is characterized by a pair of relatively flat planar linear polarized log periodic electrically conductive antennas of the kind containing a plurality of radiating elements; said pair of antennas being attached to a single relatively planar dielectric base; with the radiating elements of one antenna being interleaved with the corresponding radiating elements of the other antenna without direct electrical contact between the two antennas. In one embodiment the axes of said antennas intersecting at an approximately 90 degree angle; in another the antennas are arranged along a common axis; and as still further embodiment two pairs of antennas are oriented with the antennas of one pair being located on a common axis and the antennas of the other pair being located on a second common axis orthogonal to the first axis.

The antenna is a low profile system formed in a compact package which in one embodiment simultaneously detects both right and left circularly polarized electromagnetic waves over a broad range of frequencies, such as 2 through 18 GHz. The antenna is compact and is suited to airborne application. It is produced using existing technology. The compactness and function renders the circularly polarized planar log periodic antenna of special usefulness in airborne electronic countermeasures systems, especially in those existing ECM systems that may not be upgraded without requiring more space for antennas.

In an additional aspect to the invention a cavity backing is employed in conjunction with the two radiating elements. The "loaded" cavity suppresses radiation behind the antenna and assists in defining the antennas broadband characteristics. Further, the cavity contains broadband absorbing material which attenuates the EM fields entering the cavity so that the RF energy is dissipated and not reradiated from the interior. This absorbing material is also termed "loading material".

In a more specific aspect planar antennas according to the invention are each formed of a flat trunk or stem containing spaced outwardly extending branches to each side of the respective stem with branches of the one antenna being interleaved with branches of the other.

A novel transmission line or feed system for this arrangement is characterized by a coaxial line that extends along the underside of one stem of one antenna with the center conductor extending beyond the end of the coaxial lines outer conductor and over an insulative gap into contact with the stem of the other antenna element.

The foregoing and additional objects and advantages of the invention together with the structure characteristic thereof, which was only briefly summarized in the foregoing passages, becomes more apparent to those skilled in the art upon reading the detailed description of the preferred embodiments, which follows in this specification, taken together with the illustrations thereof presented in the accompanying drawings.

DETAILED DESCRIPTION OF THE PREFERRED EMBODIMENTS

Figure 1:
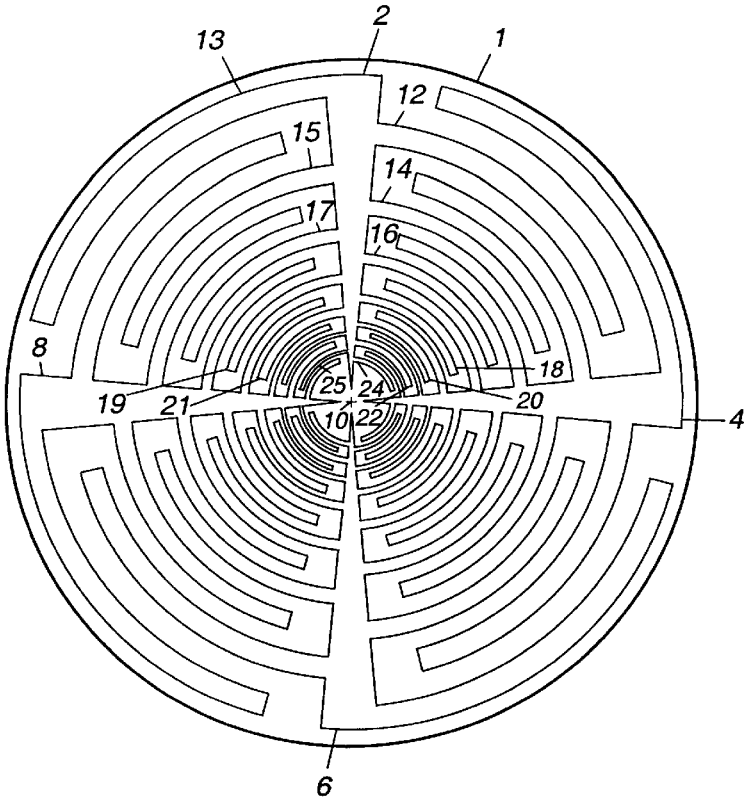
FIG. 1 illustrates in front view the geometry and relationship of the radiating elements of the antenna.

Reference is made to the front view of FIG. 1 in which is illustrated the metal radiating elements of the antenna as they appear in co-planar relationship on a planar circular dielectric base 1. This includes four separate radiating structures generally indicated as 2, 4, 6, and 8, which are equally angularly spaced by ninety degrees about center 10. Each of the individual assemblies includes a stem portion to which the numeral is directed. Further the assemblies are substantially identical in structure so that only one need be described in greater detail. Considering the one of those assemblies containing stem 2, as illustrated stem 2 is of a generally equilateral triangular shape, a triangle in which the height is substantially larger than the base. A plurality of branches 12, 14, 16, 18, 20, 22, and 24 are integral with and extend from the right side of the stem and a further plurality of branches 13, 15, 17, 19, 21, 23 and 25, appears on the other side, are integrated with and extend from the stem to the left. Each of the branches are spaced from one another at different radial distances from center 10. The spacing is determined from the well known relationship for log-periodic antennas $R(n+1)=\tau R(n)$ where $\tau<1$ and $R(n)$ denotes the outer radius of element (branch) n. As illustrated each of the branches forms a circular arc of a radius defined by the distance to the center 10 and subtends slightly less than 90 degrees so as to avoid physical contact with the stems of the two adjacent antenna assemblies to the right and to the left. As shown a circular arc is an arc taken of a circle, with a circle being a plane figure formed by a single curved line, called its circumference, every point of which is equally distant from a point within it, called the center, that distance being called the radius. The circular arc thus has a radius that is a constant, unlike a spiral or log sine curve. Although the embodiment illustrates assemblies with fourteen branches, it is understood that other embodiments may incorporate different numbers of branches, for example twenty three branches, limited only by available space.

Stems 2 and 6 are oriented on a common axis that extends through center 10 of the planar dielectric base. Further the two stems are located in opposed end to end relationship symmetrically on opposite sides of that center. In like manner stem 4 and stem 8 are located on a common axis that extends through center 10; the two stems are also located in opposed relationship symmetrically on opposite sides of that center. As shown the two axes are oriented perpendicular to one another.

The branches to the right of stem 2 in the figure are interleaved with the branches on the left side of stem 4 and do not physically contact the latter branches. The branches to the left of stem 2 in the figure are interleaved with the branches on the right side of stem 8 and do not contact the latter branches. Further the branches extending from the right and left sides of stem 6 as shown in the figure are interleaved with the branches extending from stems 4 and 8, respectively. The progressive change in the width of the branches, like the spacing, results from the well known relationship for log-periodic antennas. The inner radius of each branch is given by $r(n+1)=\tau r(n)$. The inner radius is related to the outer radius by the formula $r(n)=\in R(n)$. For the antennas shown in this specification, $\in=\sqrt{\tau}$. As shown each of the circular arcs is of increasing radius as measured from the center location 10; the arcs on stem 2 are parallel to one another and like relationship exists for those arcs on stems 6, 4, and 8; and the axis of each of the arcs on each of the stems is a line drawn perpendicular to the plane on the drawing through the center location 10 and in that sense it may be stated that the arcs are in a coaxial or concentric relationship.

Each assembly is formed of a flat electrical conductor that is attached to base 1 which is of dielectric material, suitably a fiberglass epoxy or "Teflon" polytetrafluoroethylene by way of example. As presently planned the conductors are of the metal copper of a thickness of 0.0005 inches. The base is preferably of a thickness of 0.010 inches.

The assembly may be formed by printed circuit board fabrication techniques in which a copper clad laminate is etched to produce the described conductor pattern. The details of those processes are well known and are amply described in the technical literature to which interested persons may make reference. Those details therefore need not be further described in this specification.

The frequency limits are set by the frequencies at which the longest and shortest branch elements equate in length to one quarter wavelength, the shorter branch determining the upper frequency limit and the longer branch determining the lower frequency. By way of specific example an antenna for the frequency range of 2,000 to 20,000 MHz may be of the following dimensions: outside diameter 2.0 inches; inside diameter (of highest frequency branches) 0.04 inches.

Figure 2:
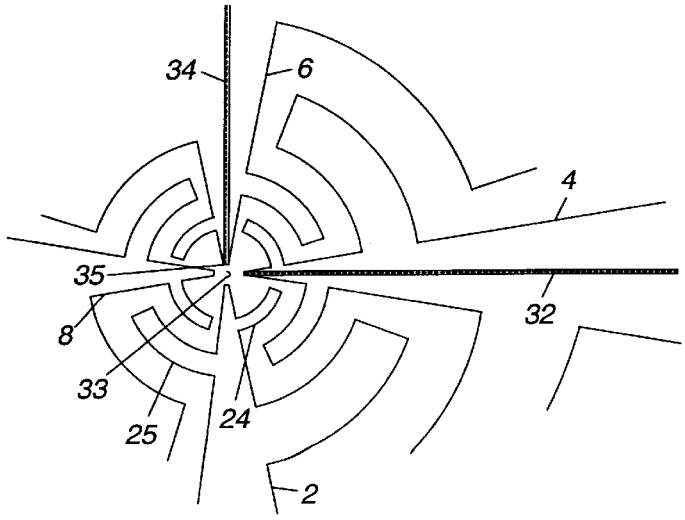
FIG. 2 is a partial view of the center portion of the embodiment of FIG. 1 as viewed from the underside illustrating the structure for feeding RF to and from the antenna.

Reference is made to the partial enlarged view of FIG. 2 which shows to an enlarged and slightly distorted scale the central portion of the antenna as viewed from the underside of FIG. 1. A coaxial transmission cable or line 32 is routed from the outer periphery of the antenna along the underside of the stem 4 with the outer cylindrical shaped shield conductor being in electrical contact with the stem. As is familiar to those skilled in the art a coaxial line contains a center conductor that is surrounded by a cylindrical shaped conductor and insulating material is included between the two conductors. The coaxial line may be jacketed with an insulator or may be left unjacketed leaving the outer conductor exposed. The coaxial line in these embodiments are preferably unjacketed.

As shown, the center conductor 33 of the transmission line is exposed, extends beyond the end of the outer conductor, and extends across the center and into electrical contact with the opposed stem 8. In like manner a second coaxial transmission line 34 is routed from the outer periphery of the antenna along the underside of stem 6 and the stem is in electrical contact with the shielding outer conductor of the line; the center conductor 35 extends beyond the end of the outer conductor and across the center and is electrically in contact with and attached to the opposed stem 2. Although not illustrated, the two coaxial cable type transmission lines extend out of the structure and are connected at the opposite ends to a 90 degree hybrid of conventional structure in a conventional manner as in prior devices of this kind.

The two transmission lines are illustrated in this embodiment as being located on the same side of the base. It is recognized that in other embodiments the transmission lines may be located on opposite sides of the base without departing from the scope of the invention. Further it is noted that assembly of the lines to the antenna may be easier if the two coaxial lines are installed on opposite surfaces of the base; so doing ensures that the exposed center conductors and the connecting wires of the lines do not interfere with one another.

Figure 3:
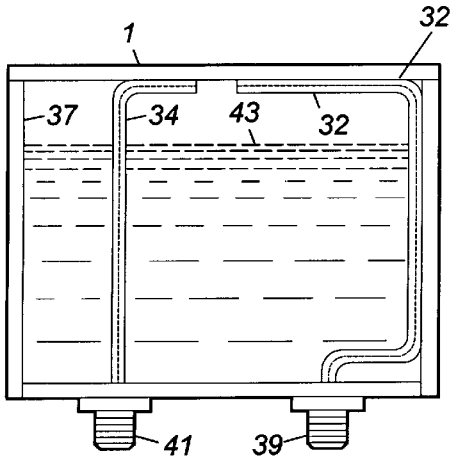
FIG. 3 is a section view of the embodiment of FIG. 1.

As illustrated to a slightly reduced scale in the section view of FIG. 3, a cylindrical housing 37, suitably metal is closed at its upper end by the disk shaped dielectric base 1, presented in FIG. 1. The coaxial transmission lines 32 and 34, partially illustrated earlier in FIG. 2, extend from the base to connection with standard coaxial connectors 39 and 41, respectively; the center conductor of each coaxial line being connected to the center conductor of the connector and the shield or outer cylindrical conductor of the coaxial line is connected to the outer conductor of the connector, neither of which is illustrated. A microwave absorbent material 43 of any conventional type is packed within the cavity.

The antenna's novel feed arrangement described is a principal benefit of the planar antenna structure described and an ancillary feature of the new combination. The maximum radiating current occurs in the active regions which is near the points where the branches connect to the feed conductor. Thus a feed transmission line routed radially along the stem from the low frequency end of the antenna structure, the outer periphery where the branches are of the greatest length, to the center of the antenna does not adversely affect the antennas—characteristic electrical impedance and its radiation pattern because the transmission line is separated from the active region of the antenna and is located in a neutral plane or plane of symmetry.

Moreover, the feed system described in this combination eliminates the need for an unbalanced to balanced transition ("balun") between the coaxial cable transmission line, which is "unbalanced", and the antenna feed point, which is "balanced" as those skilled in the art recognize upon reading this specification. Transitions for use with broadband antennas designed for operation at very short wavelengths are extremely difficult to design and construct in the applicant's opinion. Hence, an antenna structure which permits use of a simple feed system that avoids the use of such a transition represents a significant advantage. Moreover as those skilled in the art appreciate the feed system described here eliminates the need for two 180 degree hybrids, RF coupling devices which are normally required in feeding RF to and from four arm spiral antennas. The resultant cost and space savings and greater structural simplicity constitute advantages of the present invention over spiral antenna structures. If suitable baluns are, however, available, the antennas can be fed, if desired, by connecting them to the balanced terminals of the baluns. Alternatively, if 180-degree hybrids are available, the antennas can be fed by means of four coaxial cables connected to the hybrids.

In the preceding embodiment the antenna's aperture, the geometry of the front end of the antenna, was a circle. Apertures of other geometries are possible as is recognized by those skilled in the art. An example of a circularly-polarized planar log-periodic antenna constructed according to the invention that has a square aperture is shown in FIG. 4 to which reference is made.

The antenna incorporates four antennas formed of electrical conductors with the stems 46, 48, 50, and 52, respectively, angularly arranged about the center of the rectangular aperture, which is the intersection of two diagonals defining the center of the rectangle, and which in this embodiment is a square. The stems are affixed upon a planar base of dielectric material as in the prior embodiment, but which is not illustrated in this figure. The extending radiating elements or branches, which extend from the stems, are straight; which contrasts with the circular shape for those elements prescribed in the first embodiment. The branch radiating elements to one side of a given stem are oriented perpendicular to the direction of the radiating elements on the other side of the stem. Thus element 47 is perpendicular to element 49 and so on for the remaining elements integrally formed to the same stem.

Further the branch radiating elements of adjacent antennas are oriented parallel to one another; branch 47 is parallel to branch 51. Branch radiating element 54, which extends from stem 48, is parallel to the corresponding elements of the adjacent stem 48 and is interleaved between those two elements without direct physical contact. The same relationship is present with the remaining elements as is illustrated in the figure. The construction, routing and definition of the transmission lines, the coaxial cables, which couple RF to and/or from the antennas are the same as in the first embodiment; line 32 with center lead 33, and line 34 with center lead 35, but those elements are not again illustrated in FIG. 4. Moreover the support for the antenna is the same as that of FIG. 3, except that the housing 37, is instead rectangular in shape.

Figure 4:
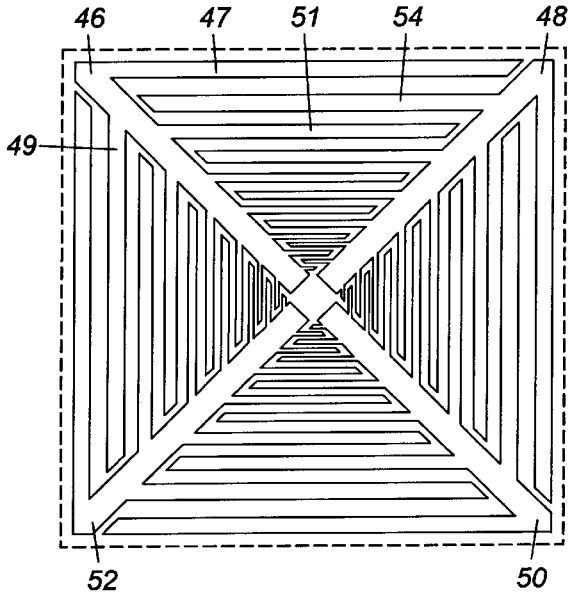
FIG. 4 illustrates an alternative embodiment of the invention containing a square aperture.

Although the stems which form the feed conductors are shown in FIG. 4 as being of a rectangular geometry, in an alternative embodiment those elements could also be triangular in shape like the corresponding elements in FIG. 1.

Figure 5:
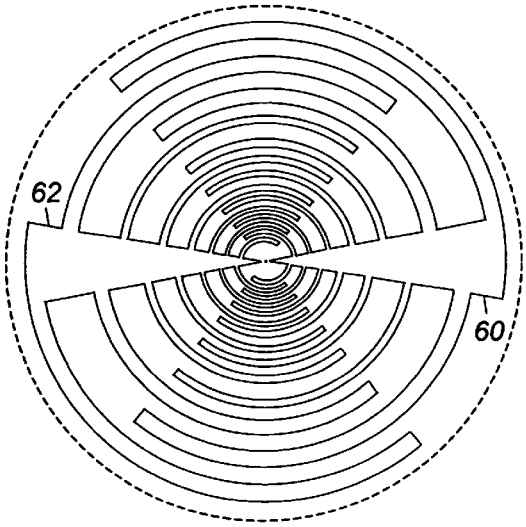
FIG. 5 illustrates a linearly polarized planar antenna embodiment using aspects of the embodiment of FIG. 1.

An example of a linearly polarized planar log-periodic antenna having two stems 60 and 62 with interleaved branch arms is shown in FIG. 5. The stems extend along a common axis and are disposed in opposed end to end relationship spaced from one another about the center of the defined circle or circular aperture. Each arm is curved in a circular arc and extends over an angle greater than 90 degrees, suitably 120 degrees as shown in the figure. The support or cavity backing elements and the feed coaxial transmission lines used in this embodiment are the same as that of FIG. 1, which elements are not again described or illustrated in connection with this embodiment. The interleaved arms enable all of these antennas to operate at a lower frequency for a given size than similar antennas without interleaved arms. The interleaved arm arrangement is another principal benefit of the antenna structure.

It is believed that the foregoing description of the preferred embodiments of the invention, including the appended claims which serve as additional description of the invention, is sufficient in detail to enable one skilled in the art to make and use the invention. However, it is expressly understood that the details of the elements which are presented for the foregoing enabling purpose are not intended to limit the scope of the invention, in as much as equivalents to those elements and other modifications thereof, all of which come within the scope of the invention, become apparent to those skilled in the art upon reading this specification. Thus the invention is to be broadly construed within the full scope of the appended claims.

What is claimed is:

1. A circularly polarized planar log periodic antenna, comprising: a pair of relatively flat planar linear polarized log periodic antennas each of the kind including a plurality of metal radiating elements spaced from one another, each of said radiating elements having the geometry of a circular arc of a constant radius with such radiating elements being oriented coaxial of one another; said pair of antennas being attached to a single relatively planar dielectric base with one of said antennas being angularly oriented by at least ninety degrees relative to the other of said antennas and with radiating elements of one antenna being interleaved with radiating elements of the other antenna without direct electrical contact between said antennas of said antenna pair.

2. A circularly polarized planar antenna, comprising:

four radiating conductor assemblies of a relatively flat geometry;

a relatively flat base of dielectric material, with said base including a center position;

each of said assemblies being attached to said base and being evenly angularly spaced about and facing said base center position;

each of said radiating assemblies further comprising:

an elongated conductive strip having first and second ends to form a stem, said stem having a width dimension at said second end greater than the width dimension at said first end and wherein said width dimension of said stem progressively increases from said first end to said second end as a function of the distance from said first end;

a plurality of conductive strips forming branches to said stem, and said branches being spaced from one another with said plurality being divided into first and second portions, said first portion of said branches being integrally attached to and extending from the right side of said stem and said second portion of said branches being integrally attached to and extending from the left side of said stem;

each said branch being of the form of a circular arc; and each said branch having a length dimension and wherein the length dimension of said branches progressively increases in length from branch to branch as a function of the radial distance of the respective branch from said first end of said stem;

and with each of said four assemblies being angularly positioned 90 degrees apart about said center position of said dielectric base with the first end of said stems in said assemblies spaced a predetermined distance from and facing said center position to prevent direct electrical contact between said stems and with said branches of adjacent ones of said assemblies being interleaved without direct contact between said assemblies.

3. The invention as defined in claim 2, further comprising:

first transmission line feed means connected to the first ends of a first pair of opposed ones of said stems for feeding RF energy therebetween;

second transmission line feed means connected to the first ends of a remaining pair of opposed ones of said stems for feeding RF energy therebetween; and wherein said first and second transmission line feed means being physically mounted and routed in a path overlying or underlying one of said stems to prevent said feed lines from interfering with operation of said antenna.

4. The invention as defined in claim 2, further comprising in combination: a cavity backing for said assemblies and base.

5. The invention as defined in claim 2, further comprising:

A metal container defining a cavity and having an open end;

with said dielectric base being located closing said open end of said metal container.

6. An antenna combination, comprising in combination:

a first pair of relatively flat planar linear polarized log periodic antennas each of the kind including a central stem having first and second ends and a plurality of metal radiating elements spaced apart along and branching outwardly from said stem, with each of said radiating elements having the geometry of a circular arc;

said pair of antennas being attached along a common axis to a single relatively planar dielectric base and being oriented in opposed relationship with said first ends of said central stems thereof spaced from and in confronting relationship with one another;

a second pair of relatively flat planar linear polarized log periodic antennas each of the kind including a central stem having first and second ends and a plurality of metal radiating elements spaced apart along and branching outwardly from said stem, with each of said radiating elements having the geometry of a circular arc;

said second pair of antennas being attached along a common axis to said relatively planar dielectric base and being oriented in opposed relationship with said first ends of said central stems thereof spaced from and in confronting relationship with one another;

said first and second pairs of antennas being of substantially identical shape and geometry;

said common axis of said first antenna pair and said common axis of said second antenna pair intersecting and bisecting one another and forming an angle therebetween of ninety degrees; and said radiating elements of said first pair of antennas being interleaved with the corresponding adjacent radiating elements of the second pair of antennas without direct electrical contact between said radiating elements of any one of said antennas with the radiating elements and central stem of any other one of said antennas.

7. An antenna, comprising in combination:

a first pair of relatively flat planar linear polarized log periodic antennas each of the kind including a central stem and a plurality of metal radiating elements branching from said stem, each of said radiating elements having the geometry of a circular arc; said pair of antennas being attached along a common axis to a single relatively planar dielectric base and being oriented in opposed relationship with the ends of the central stems spaced from one another;

a second pair of relatively flat planar linear polarized log periodic antennas each of the kind including a central stem and a plurality of metal radiating elements branching from said stem, each of said radiating elements having the geometry of a circular arc; said pair of antennas being attached along a common axis to said single relatively planar dielectric base and being oriented in opposed relationship with the ends of the central stems spaced from one another;

said antennas being of substantially identical shape and geometry;

said common axis of said first antenna pair and said common axis of said second antenna pair intersecting one another and forming an angle therebetween of ninety degrees to form a symmetrical arrangement about either of said two axes;

said radiating elements of said first pair of antennas being interleaved with the corresponding adjacent radiating elements of the second pair of antennas without direct electrical contact between the radiating elements of any one pair of antennas with the radiating elements and central stem of the other pair of antennas;

first and second coaxial transmission lines, each of said transmission lines containing a cylindrical outer conductor, a center conductor and insulating material therebetween;

said center conductor of each transmission line extending a predetermined length beyond the end of said center conductor, said predetermined length being at least as great as the distance between the opposed ends of said antennas in either of said antenna pairs;

said first transmission line being routed along a stem of one antenna of said first antenna pair with the outer conductor thereof in contact therewith and with said extending length of center conductor extending into contact with the stem of the second antenna in said first antenna pair; and said second transmission line being routed along a stem of one antenna of said second antenna pair with the outer conductor thereof in contact therewith and with said extending length of center conductor extending into contact with the stem of the second antenna in said second antenna pair.

8. The invention as defined in claim 7 comprising further in combination: a housing defining a metal walled cavity, said cavity being open at one end; said housing supporting said dielectric base within said end opening to close said housing; with said antennas being located on the side of said dielectric base facing outwardly of said housing; and means within said housing for permitting extension of said first and second transmission lines through said housing walls.

9. A planar log periodic antenna, comprising: a pair of relatively flat planar linear polarized log periodic antennas each of the kind including a central stem and a plurality of metal radiating elements attached to and spaced apart along and extending outwardly from said central stem, with at least one of said elements extending outwardly from a first side of said central stem and at least another one of said elements extending outwardly from an opposite side of said central stem; said pair of antennas being attached on a planar side to a single relatively planar dielectric base; with said radiating elements of one antenna in said pair being interleaved with radiating elements of the other antenna in said pair without direct electrical contact between said radiating elements and central stem of any one antenna of said pair with the radiating elements and central stem of the other antenna of said pair.

10. The antenna defined in claim 9 wherein each of said radiating elements is of the geometry of a circular arc.

11. The antenna as defined in claim 9 wherein each of said radiating elements is of the geometry of a straight line.

12. The antenna as defined in claim 9 wherein one of said antennas is angularly oriented by ninety degrees relative to the other of said antennas.

13. The antenna as defined in claim 12 wherein each of said radiating elements is of the geometry of a circular arc and wherein said circular arc extends over less than 90 degrees.

14. The antenna as defined in claim 9 wherein said antennas are oriented along a common axis in end to end opposed relationship.

15. The antenna as defined in claim 14 wherein each of said radiating elements is of the geometry of a circular arc and wherein said circular arc extends over more than 90 degrees and less than 180 degrees.

16. The antenna as defined in claim 12 further comprising in combination: coaxial cable transmission line means having a center conductor and a cylindrical outer conductor, said center conductor having an end portion extending beyond the end of said outer conductor; said transmission line means, exclusive of said end portion of said center conductor, being located in an underlying relationship to one of said antennas; said center conductor end portion extending from the end of one antenna over the gap to the adjacent end of the other antenna.

17. The antenna as defined in claim 15 further comprising in combination: coaxial cable transmission line means having a center conductor and a cylindrical outer conductor, said center conductor having an end portion extending beyond the end of said outer conductor; said transmission line means, exclusive of said end portion of said center conductor, being located in an underlying relationship to one of said antennas; said center conductor end portion extending from the end of one antenna over the gap to the adjacent end of the other antenna and said outer conductor being in contact with said one antenna.

18. The antenna as defined in claim 9, further comprising in combination: coaxial cable transmission line means having a center conductor and a cylindrical outer conductor, said center conductor having an end portion extending beyond the end of said outer conductor; said transmission line means, exclusive of said end portion of said center conductor, being located in an underlying relationship to one of said antennas; said center conductor end portion extending from the end of one antenna over the gap to the adjacent end of the other antenna.

19. The invention as defined in claim 9 wherein said central stem in each of said antennas in said pair of antennas comprises further:

a first stem portion and a second stem portion, with said first and second stem portions being spaced from one another along a common axis and with each of said stem portions including one half of said plurality of radiating elements.

20. The invention as defined in claim 19 wherein said radiating elements are of the geometry of a circular arc and wherein all said radiating elements are arranged in concentric relationship.

21. The invention as defined in claim 19 wherein said radiating elements are of the geometry of a straight line and wherein each of said radiating elements extends from an associated stem at an angle of forty five degrees from the axis of said associated stem.

* * * * *